United States Patent [19]

Tone

[11] Patent Number: 5,065,949

[45] Date of Patent: Nov. 19, 1991

[54] AUTOMATIC INSPECTING APPARATUS FOR YARN JOINING DEVICE

[75] Inventor: Shoichi Tone, Kyoto, Japan

[73] Assignee: Murata Kikai Kabushiki Kaisha, Kyoto, Japan

[21] Appl. No.: 431,466

[22] Filed: Nov. 2, 1989

[30] Foreign Application Priority Data

Nov. 2, 1988 [JP] Japan ..... 63-142747[U]

[51] Int. Cl.[5] ..... B65H 54/20; B65H 54/22; B65H 63/00; G01L 5/04

[52] U.S. Cl. ..... 242/35.5 R; 242/35.6 R; 242/36; 73/160

[58] Field of Search ..... 242/35.5 R, 35.5 A, 242/36, 35.6 R, 18 R; 73/159, 160, 826, 828, 830, 834

[56] References Cited

U.S. PATENT DOCUMENTS 4,703,651 11/1987 Mima ..... 73/160
4,733,829 3/1988 Mima ..... 242/35.6 R

FOREIGN PATENT DOCUMENTS 61-146827 7/1986 Japan .

*Primary Examiner*—Stanley N. Gilreath
*Attorney, Agent, or Firm*—Spensley Horn Jubas & Lubitz

[57] ABSTRACT

The automatic inspecting apparatus for a yarn joining device comprises devices for judging, when more than predetermined times of measured results within the doffing process are recognized to be abnormal, such, as a defective spindle, for generating an abnormal signal when judged to be abnormal, for setting a joining button of the winding unit to a joining stop position in response to the abnormal signal, and for flickering a lamp associated with the winding unit in response to the abnormal signal.

12 Claims, 3 Drawing Sheets

AUTOMATIC INSPECTING APPARATUS FOR YARN JOINING DEVICE

FIELD OF THE INVENTION

The present invention relates to an automatic inspecting apparatus for a yarn joining device, and more specifically, to an automatic inspecting apparatus which moves together with a doffing carriage along a winder having a number of winding units arranged thereon, each winding unit being provided with a yarn joining device, to collect sample yarns including a joint portion of yarns plural times within the doffing process to measure the strength of the joint in the winding unit.

RELATED ART STATEMENT

Generally, winding units arranged in plurality to constitute an automatic winder are each provided with a slub catcher for detecting and cutting off an unevenness of yarn such as coarse yarn and with a yarn joining device for re-connecting ends of cut yarns together so that a normal yarn is merely wound on a winding package. This yarn joining device includes a knotter for mechanically forming a knot or a so-called splicer for twisting together yarn ends by an air stream to form a spliced joint having no knot.

Since sufficient strength and elongation are required for the joint joined by the joining device, it is necessary to check carefully the performance of the joining device so as not produce an insufficient joint.

An automatic inspecting apparatus for a yarn joining device has been known (from Japanese Patent Application Laid-Open No. 146827/1986), which corresponds to U.S. Pat. No. 4,703,651, issued Nov. 3, 1987, which is assigned to the assignee of the instant application and which is incorporated herein in its entirety by reference, in which an inspecting apparatus movable along winding units automatically collects sample yarns including a joint portion of joined yarns from the winding units to measure the strength, elongation or the like of the joint and check the performance of the joining device from the measured results. In this automatic inspecting apparatus, the maximum displacement of a distortion gauge produced at the time of rupture of the joint of the sample yarn is converted into a load value, and the yarn strength is digitally displayed as the gram number or written into a recording paper. When predetermined times of measurements are carried out at one winding unit position, the apparatus is started for its movement to the next winding unit.

However, in the above-described automatic inspecting apparatus, each of the measured result is displayed on a display portion of the automatic inspecting apparatus itself or written onto the recording paper. Evaluation of each winding unit with respect to the joining device had not been carried out unless a considerable time has passed. That is, the measured result for one day is printed out at the time once stored and required, for example, at the end of daily operation or next morning. The measured result may be used next day, and therefore, there is a problem that a stop time for the winding unit becomes long.

SUMMARY AND OBJECT OF THE INVENTION

It is an object of an embodiment of the present invention to propose, an inspecting apparatus for a yarn joining device which can quickly tell a defective winding unit of the joining device, and accordingly can promptly carry out the process for a defective spindle, as a consequence of which the stop time of the winding unit can be reduced.

The automatic inspecting apparatus for a yarn joining device according to the embodiment of the present invention mentioned above comprises judging means for judging, when more than predetermined times of measured results within the doffing process are recognized to be abnormal, such, as a defective spindle, means for generating an abnormal signal when judged to be abnormal, means for setting a joining button of the winding unit to a joining stop position in response to the abnormal signal, and means for flickering a lamp associated with the winding unit in response to the abnormal signal.

When more than predetermined times of measured results attained by the inspecting apparatus within the doffing process by the doffing carriage are recognized to be abnormal, the judging means judges it as a defective spindle. Then, an abnormal signal is generated to stop the winding unit and flicker a lamp associated with the winding unit. Therefore, an operator can immediately know the presence of the winding unit which is defective in joint among a number of winding units or the presence of the winding unit thereof. Accordingly, processing for removing the defect of the joint can be quickly carried out, and the stop time of the winding unit is also reduced.

DETAILED DESCRIPTION OF PREFERRED EMBODIMENT

One embodiment of the present invention will be described in detail with reference to the accompanying drawings.

Figure 1:
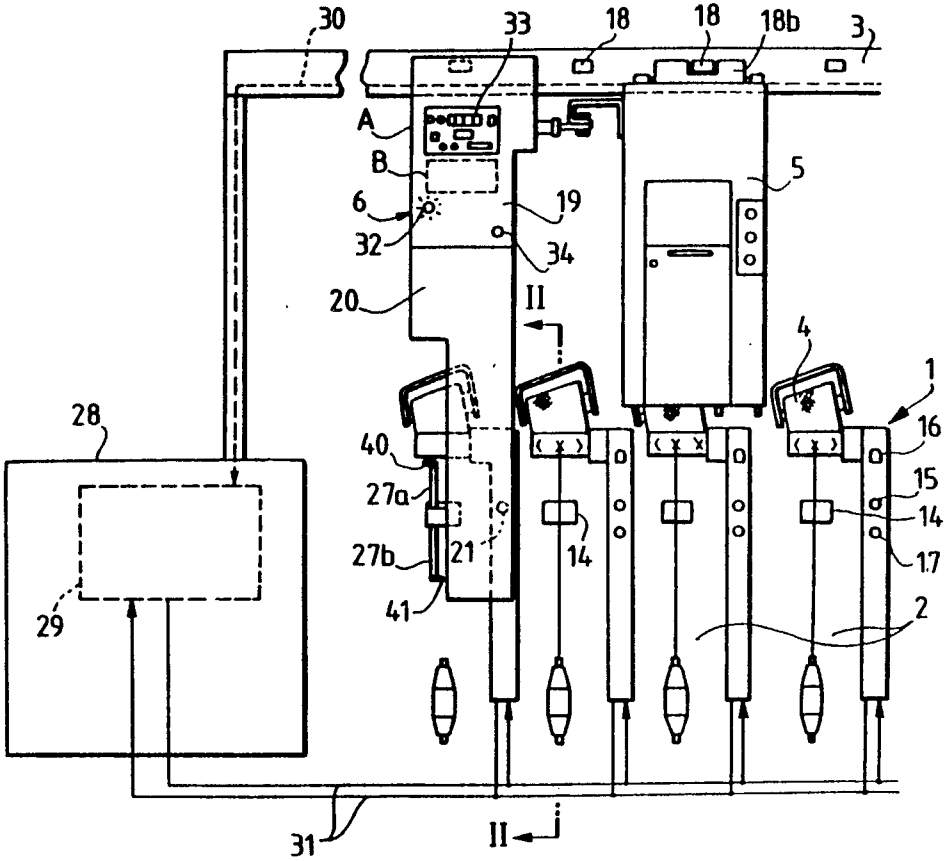
FIG. 1 is a front view showing one embodiment of an automatic inspecting apparatus for a yarn joining device according to the present invention.

In FIG. 1, reference numeral 1 designates an automatic winder with a plurality of winding units 2. A doffing carriage 5 is supported to travel on the rail 3 provided above the automatic winder 1 to doff a fully wound package 4 wound by the winding unit 2 to exchange it with an empty bobbin and an inspecting apparatus 6 connected to and moved by the carriage 5 is movably supported. The inspecting apparatus, which is discussed in more detail hereinbelow, corresponds to the inspecting apparatus disclosed in the above-referenced U.S. Pat. No. 4,703,651 which has been incorporated herein in its entirety by reference.

Figure 2:
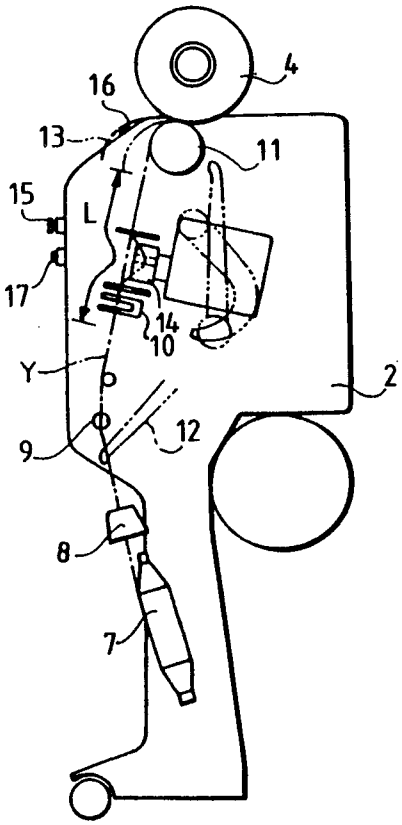
FIG. 2 is a schematic sectional view taken on a line II—II of FIG. 1.

As shown in FIG. 2, the winding unit 2 constituting the automatic winder 1 guides a yarn Y upwardly via a guide 8, a tensor 9 for applying a suitable tension and a slub catcher 10 for detecting an unevenness of yarn from a feed bobbin 7 and the yarn is wound on the winding package 4 rotated by a drum 11. In each winding unit 2, when an unevenness of yarn is detected, the yarn being wound is cut and the winding is stopped. A first yarn guide suction arm 12 and a second yarn guide suction arm 13 are actuated to guide the yarn end on the feed bobbin 7 side and the yarn end on the winding package 4 side, respectively, to a joining device 14 provided at a position away from the normal yarn travelling route, where yarn joining is effected thereat to continuously wind yarns.

A yellow button 15 at a depressed position during the winding operation is provided on the front surface of the winding unit 2 so that when the yellow button 15 is pulled out, winding stops and when the button is again depressed, the joining operation is carried out.

When the winding package 4 is fully wound, a green lamp 16 on the front surface of the winding unit 2 is lit, that is, the green lamp 16 is flickered at a constant period, and the yellow button 15 is automatically pushed out to stop the winding operation. When a start button 17 is depressed, the winding operation is restarted. The doffing carriage 5 stops on the winding unit 2 where the green lamp 16 is lit to effect doffing. In order to position the doffing carriage 5 on the winding unit 2, a plate 18 is mounted on the rail 3. The doffing carriage 5 and the inspecting apparatus 6 connected thereto are designed so that a position of the plate 18 is detected by a sensor (not show) and they are positioned and locked while being engaged at a dog **18*b* with the plate 18**.

The inspecting apparatus 6, details of which are incorporated by reference from U.S. Pat. No. 4,703,651, is connected to the doffing carriage 5 and is opposed to the third winding unit 2 in the illustration to effect plural times (N times) of inspections within the doffing process, that is, sample yarns including the joint portion of the joined yarn are collected N times for measurement.

The inspecting apparatus 6 has an upper box 19 which encases therein an inspection and control device for an electric system. A device a for storing the measured value on a recording paper and an evaluation device B. A lower box 20 encases therein mechanical portions for the yarn collection and measurement as the inspection apparatus body.

Mounted on the inspecting apparatus body provided on the lower box are an operating rod 21 for operating the yellow button 15, collecting arms **27*a* and 27*b* for collecting sample yarns from the winding unit 2 to deliver them to a pair of clamps of a measuring machine not shown, and the like. Examples of collecting arms can be seen in the above-referenced U.S. Pat. No. 4,703,651 where upper and lower arms 7 and 8 operate in conjunction with upper and lower clamps 140, 141, respectively. For example, see FIG. 5** of the '651 patent.

The operation will be described hereinafter.

When the inspecting apparatus 6 is positioned on the winding unit 2 of the automatic winder 1, the operating rod 21 pulls out the yellow button 15 of the winding unit 2 to stop the winding operation of the winding unit 2, after which the yellow button is depressed to effect the yarn joining operation.

Next, the upper yarn collecting arm **27*a* rotates toward the winding unit 2 and advances to embrace the upper side of the sample yarn including the joint portion of the joined yarn by the rotation of a yarn gathering lever 40, and the yarn is cut by an upper cutter (not shown) and only the upper end of the sample yarn is gripped. An example of an upper cutter can be seen in U.S. Pat. No. 4,703,651 where the upper arm 7 includes a cutting and holding device 3. Thereafter, the upper yarn collecting arm 27*a* moved backward while gripping the upper end of the sample yarn to deliver it to the upper clamp. When the upper clamp grips the upper end of the sample yarn, the upper cutter releases the sample yarn. Next, the lower yarn collecting arm 27*b* rotates and advances so that the side lower than the joint portion of the sample yarn is embraced while being gathered by rotation of a yarn gathering lever 41, and the arm 2 moves backward to deliver the yarn to the lower clamp. When the lower clamp grips the lower end of the sample yarn, the portion lower than the gripped portion of the sample yarn is cut by the lower cutter (not shown). An example of a lower cutter can be seen in U.S. Pat. No. 4,703,651 where the lower arm 8 includes a cutting and holding device 4**.

Then, the upper clamp is moved so as to apply a tension to the sample yarn. The tension is applied till the sample yarn is broken, and the tension, elongation or the like of the sample yarn including the joint portion are measured.

The aforementioned measurement is carried out plural times (N times) with respect to the third winding unit in the illustration being doffed within the time of being doffed.

Figure 3:
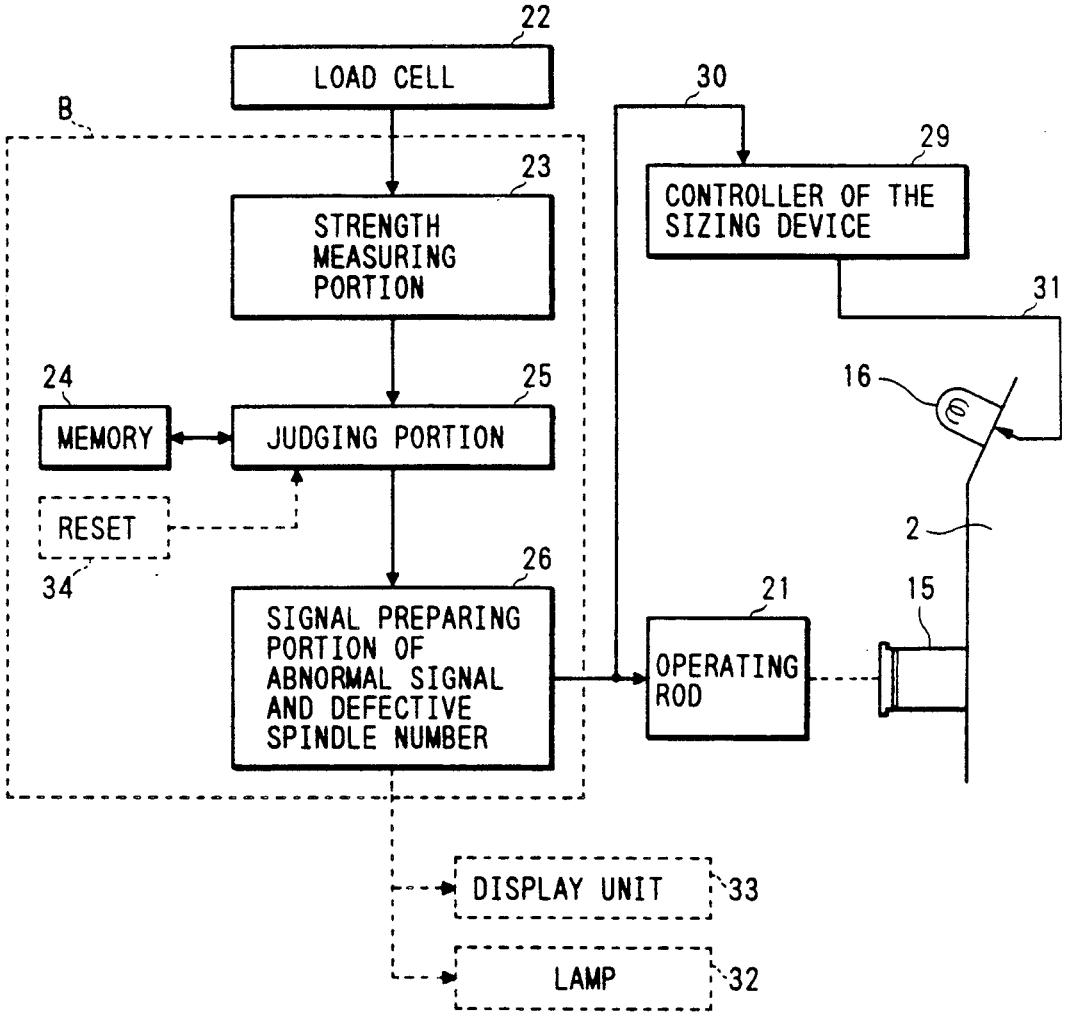
FIG. 3 is a control block showing a relation between an evaluation device of the inspecting apparatus and the winding unit.

FIG. 3 is a block diagram showing a control relation between the inspecting apparatus body, an evaluation device B including CPU and the winding unit 2.

The evaluation device B has a strength measuring portion 23 for reading every time a measured value of a physical amount of strength or the like obtained over plural times from the load cell 22 of the inspecting apparatus body within the doffing process, and a judging portion for judging the propriety of each measured value to store the result therefrom in the memory 24. The judging portion 25 judges that unsuitable measured result reached a predetermined limited value (n times) and that the winding unit is a defective spindle. A signal preparing portion 26 of abnormal signal and defective spindle number outputs an abnormal signal thereof as well as a spindle number on the basis of the judgement made. The abnormal signal causes the operating rod 21 of the inspecting apparatus 6 to actuate and magnetically attract the yellow button 15. Thereby, the winding unit stops.

On the other hand, the spindle number constituting the abnormal signal and a part thereof is sent to a controller 29 of a sizing device 28 for measuring and determining length of the wound yarn (see FIG. 1) of the winder arranged at the end of a group of winding units. Upon reception of this signal, the controller 29 of the sizing device sends a signal to the winding unit of the designated spindle number to flicker the green lamp at a period different from that when the winding package 4 is fully wound. In this case, communication from the winding unit 2 to the sizing device 28 is carried out through a communication line 30 (see FIG. 1) installed additionally to three feeders laid within the rail 3 for the doffing carriage, and communication from the sizing device 28 to the winding unit 2 is carried out by the existing communication line 31.

Where the defective spindle of the joining device 14 is found as described above, not only the winding unit 2 stops but the green lamp 16 abnormally flickers. Therefore, the operator can know immediately the winding unit of defective yarn joint among a number of winding units. Accordingly, processing for removing the defect of the joint can be promptly carried out, and the time of stopping the winding unit is much reduced as compared with the prior art.

In the above embodiment, the evaluation device B has judged the defective spindle from the fact that the unadequate measured result reached the set value (n times). However, the winding unit is judged to be the defective spindle from the fact that the measured values of plural times (N times) are obtained from the load cell of the inspecting apparatus body within the doffing process, which is synthetically evaluated, and abnormal condition of the yarn joint of the predetermined times among N times, for example abnormal condition of the 10th yarn joint is found.

While in the above-described embodiment, the green lamp of the winding unit is flickered at a period different from that when the package is fully wound, it is noted that an alarm lamp can be provided on the side of the inspecting device 6. That is, where the winding unit judged to be defective in joint is one spindle, the alarm lamp 32 is immediated flickered, so that judgement which spindle is defective can be grasped by displaying the defective spindle number on the display unit 33 of the inspecting apparatus 6. In this case, a reset button 34 is provided on the inspecting apparatus 6 so that the alarm lamp 32 and the display unit 33 are turned off by depressing the reset button 34. The merit of this embodiment lies in the absence of the communication cable from the inspecting apparatus 6 to the sizing device. The reset button is preferably designed so that the stored number of the defective spindle numbers stored every depression is erased and the alarm lamp is turned off when the stored number is zero for the preparation of the presence of a plurality of defective spindles.

It is noted that in the winder composed of a number of winding units, a winding unit which stops its operation for some cause is sometimes present. When such operation-stop time becomes long, doffing is not carried out in that stopped unit. Therefore, in case of the above-described embodiment, checking of the third unit from the stopped unit is not carried out.

Accordingly, in the present application, control for preventing disablement of such checking is carried out. That is, for example, for the unit in which the measuring times is less than twice, measurement is carried out irrespective of doffing so as not to provide a difference in times of measurement.

Figure 4:
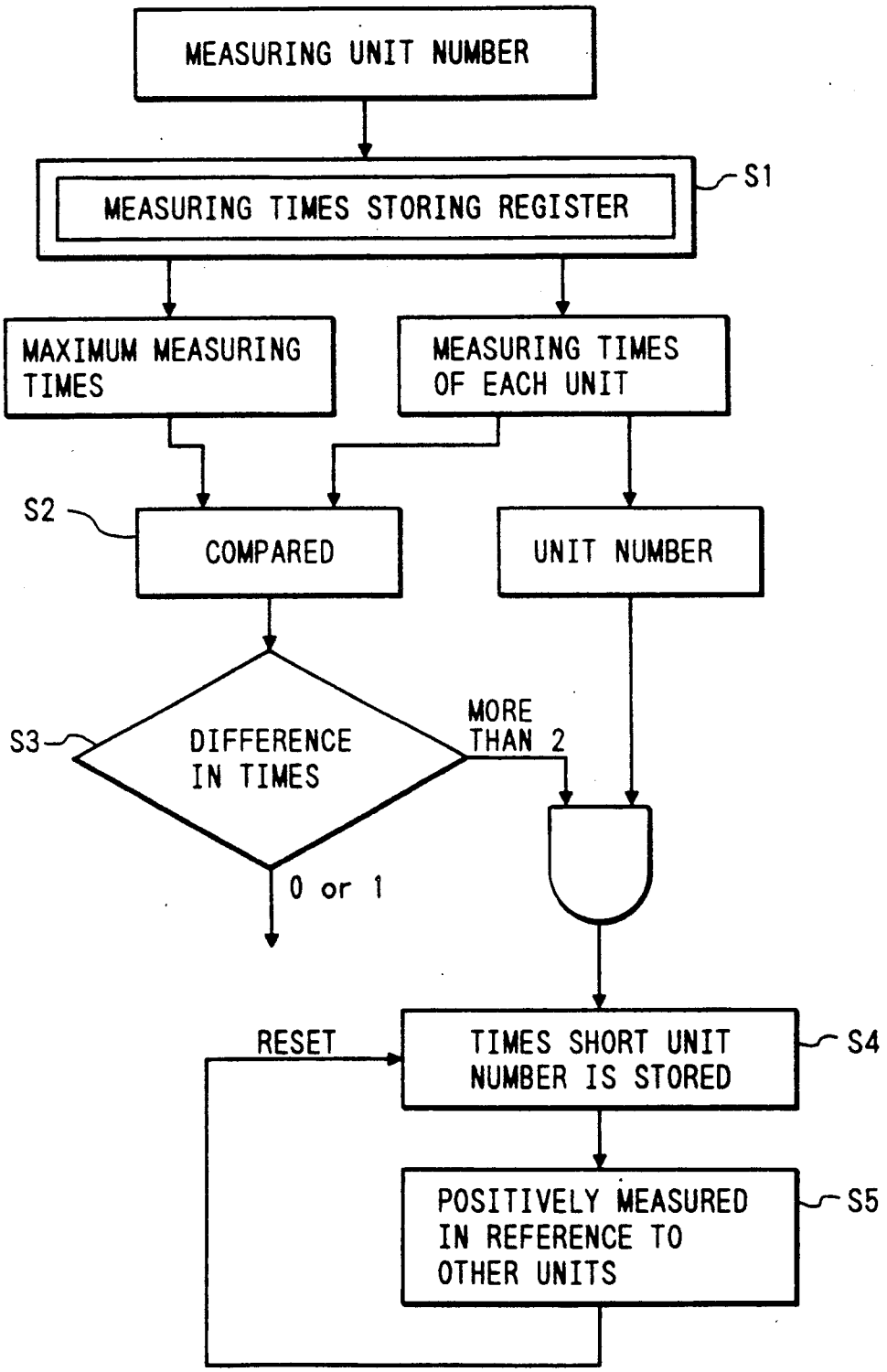
FIG. 4 is a control block diagram for uniformly carrying out a measurement of winding units.

In FIG. 4, when the inspecting device 6 stops for measurement, measuring unit No. is input into a measuring times storing register (S1). Next, the measuring times of each unit is compared with the maximum measuring times (S2). Where the difference in times thereof is more than as set (S3), the times short unit No. is stored (S4).

When the unit occurs, it is positively measured in preference to other units (S5).

The unit No. can be discriminated by an address display plate provided on each unit or other well known means.

Even if the unit which disables doffing should occur, the inspection will not be disabled.

According to embodiment of the present invention, the operator can immediately know the presence of the winding unit which is defective in joint among a number of winding units. Accordingly, processing for removing the defect of the joint can be promptly carried out, and the stop time of the winding unit is also reduced.

What is claimed is:

1. In an inspection apparatus which moves together with a doffing carriage along a winder having a number of winding units arranged thereon, each winding unit being provided with a yarn joining device operable to join yarn and thereby provide a joint portion for each joining operation, the inspection apparatus having means for collecting sample yarns including a joint portion of yarns plural times within the doffing process to measure the strength of the joint in the winding unit, an automatic inspecting apparatus for a yarn joining device comprising:

judging means for judging, when more than predetermined times of measured results within said doffing process are recognized to be abnormal, as a defective spindle;

means for generating an abnormal signal when judged to be abnormal;

means for setting a yarn joining button of the winding unit to a yarn joining stop position in response to the abnormal signal; and means for flickering a lamp associated with said winding unit in response to the abnormal signal.

2. The automatic inspecting apparatus as claimed in claim 1, wherein said apparatus further includes means for inputting a measuring unit number into a measuring times storing register when a yarn strength of the sample yarn is measured during the doffing process, for comparing the measuring times of each unit with the maximum measuring times and for positively measuring regardless the doffing process at the unit where the measuring times are less than the standard times.

3. The automatic inspecting apparatus as claimed in claim 1, wherein said automatic inspecting apparatus further comprises a device for storing the measured value on a recording paper, an evaluation device, and an inspection apparatus body for a yarn collection and measurement.

4. The automatic inspecting apparatus as claimed in claim 3, wherein said inspection apparatus body includes means for applying a tension to the sample yarn till the sample yarn is severed, and means for measuring the tension, elongation or the like of the sample yarn having the joint portion applying the tension to a load cell.

5. The automatic inspecting apparatus as claimed in claim 4, wherein said evaluation device comprises a strength measuring portion for reading every time a measured value of an amount of strength or the like obtained from the load cell of the inspecting apparatus body, and a judging portion for judging the propriety of each measured value to store the result therefrom in a memory.

6. An inspection apparatus which moves together with a doffing carriage for performing a doffing operation, the inspection apparatus and doffing carriage being moveable along a winder having a number of winding units, each winding unit being provided with a yarn joining device operable to join yarn and thereby provide a joint portion for each joining operation and a yarn joining stop button, the inspection apparatus comprising:

means for collecting plural sample yarns from one of the winding units during a doffing operation performed on anther one of the winding units, each sample yarn including a joint portion of yarn;

means for measuring the strength of the joint in each collected sample yarn;

means for determining whether the measured strength of the joint is abnormal;

judging means for judging, when more than a predetermined number of measured results are determined to be abnormal;

means for providing an abnormal signal when more than a predetermined number of measured results are determined to be abnormal; and means for setting the yarn joining button of the winding unit to a yarn joining stop position in response to the abnormal signal.

7. An inspection apparatus as claimed in claim 6, further compising means for flickering a lamp associated with said winding unit in response to the abnormal signal.

8. The inspecting apparatus as claimed in claim 6, wherein said apparatus further comprises:

means for determining the number of measuring operations performed by the means for measuring on each winding unit;

storing means for storing a number corresponding to a maximum number of measuring operations;

comparing means for comparing the number of measuring operations performed on each unit with the maximum number of measuring operations; and means for controlling the means for measuring to positively perform a measuring operation regardless of the doffing process at a unit where the number of measuring operations is less than the maximum number of measuring operations.

9. The inspecting apparatus as claimed in claim 6, further comprising a device for storing on a recording paper data corresponding to a value of the measured strength.

10. The inspection apparatus as claimed in claim 9, further comprising an inspection apparatus body, wherein the inspection apparatus body includes:

means for applying a tension to the sample yarn until the sample yarn is severed; and means for measuring at least one of the tension and elongation of the sample yarn.

11. In an automatic winder having a plurality of winding units and a doffing carriage moveable along the winder for performing a doffing operation on each winding unit, each winding unit being provided with a yarn joining device operable to join yarn and thereby provide a joint portion for each joining operation and a yarn joining stop button, the improvement consisting of an inspection apparatus comprising:

an inspection apparatus body;

connector means for connecting the doffing carriage and the inspection apparatus body such that the inspection apparatus body is moveable along the winder with the doffing carriage;

means for collecting plural sample yarns from each winding unit, each sample yarn including a joint portion of yarn;

means for measuring the strength of the joint in each collected sample yarn;

means for determining whether the measured strength of the joint is abnormal;

judging means for judging, when more than a predetermined number of measured results are determined to be abnormal;

means for providing an abnormal signal when more than a predetermined number of measured results are determined to be abnormal; and means for setting the yarn joining button of the winding unit to a yarn joining stop position in response to the abnormal signal.

12. In an inspection apparatus which moves together with a doffing carriage for performing a doffing operation, the inspection apparatus and doffing carriage being moveable along a winder having a number of winding units, each winding unit being provided with a yarn joining device operable to join yarn and thereby provide a joint portion for each joining operation and a yarn joining stop button, a method of inspection comprising the steps of:

performing a doffing operation on a first one of the winding units;

collecting plural sample yarns from a second one of the winding units during a doffing operation performed on the first one of the winding units, each sample yarn including a joint portion of yarn;

measuring the strength of the joint in each collected sample yarn;

determining whether the measured strength of the joint is abnormal;

determining whether more than a predetermined number of measured results are determined to be abnormal;

providing an abnormal signal when more than a predetermined number of measured results are determined to be abnormal; and setting the yarn joining button of the winding unit to a yarn joining stop position in response to the abnormal signal.

* * * * *